United States Patent [19]

Tetenborg et al.

[11] 4,249,361

[45] Feb. 10, 1981

[54] METHOD OF FULLY AUTOMATICALLY FILLING AND CLOSING LARGE SACKS

[75] Inventors: Konrad Tetenborg; Helmut Huwelmann, both of Lengerich, Fed. Rep. of Germany

[73] Assignee: Windmoller & Holscher, Lengerich, Fed. Rep. of Germany

[21] Appl. No.: 34,025

[22] Filed: Apr. 27, 1979 (Under 37 CFR 1.47)

[30] Foreign Application Priority Data

Apr. 27, 1978 [DE] Fed. Rep. of Germany ..... 2818552

[51] Int. Cl.[3] ..... B65B 51/08

[52] U.S. Cl. ..... 53/415; 53/417; 53/469; 53/479; 53/482; 53/137; 53/570

[58] Field of Search ..... 53/414, 415, 417, 419, 53/459, 469, 479, 482, 583, 137, 570

[56] References Cited

U.S. PATENT DOCUMENTS 3,922,834 12/1975 Clayton ..... 53/583 X
4,162,602 7/1979 Achelpohl et al. ..... 53/415

FOREIGN PATENT DOCUMENTS 123946 3/1931 Austria .

*Primary Examiner*—Travis S. McGehee
*Attorney, Agent, or Firm*—Fleit & Jacobson

[57] ABSTRACT

In a method of automatically closing a large upright sack after filling, the top of the flattened filling end of the sack is folded over onto itself and a closure tape is secured to the folded-over portion and one wall of the sack, whereafter the filling end is re-erected substantially vertically, folded in zig-zag fashion and pulled together to form a frill. The ends of the tape project beyond both sides of the filling end so that, after zig-zag folding of the filling end and tape and after the frill has been formed, the tape ends project from the same side of the frill and can be interconnected.

5 Claims, 11 Drawing Figures

METHOD OF FULLY AUTOMATICALLY FILLING AND CLOSING LARGE SACKS

The invention relates to a method of fully automatically filling and closing large sacks, wherein a sack provided with a base is engaged laterally at the upper end of its open filling side, is opened by pulling the sack walls apart, the pourable material is first filled into the freely suspended sack, the sack is during this time slowly deposited on a support whilst maintaining tension in the side walls, the upper end of the filling side is closed by stretching the side walls, and the sack walls disposed above the filling material are placed together and turned over sideways through an angle, wherein the upper end of the flattened filling side is then folded over onto itself, a closure tape is placed onto the folded-over end and one sack wall and welded to the sack wall and folded-over end by two parallel weld seams, and wherein the empty upper end of the filling side is re-erected substantially vertically, folded in zig-zag fashion and pulled together to form a frill, according to U.S. Pat. No. 4,162,602.

In the method according to the parent patent, the filling side of the filled sack that has been pulled together to a frill is held together by placing an annular clip about the pulled-together sack portion beneath the frill.

It is the problem of the present invention to improve the method of the parent patent by dispensing with an additional annular clip and securing the frill with the aid of simple expedients against springing open.

This problem is solved according to the invention in that the ends of the closure tape folded in zig-zag fashion together with the filling side, said ends projecting beyond both sides of the flattened filling side and projecting from the same side of the frill, are welded to each other for securing the frill against springing open. The frill pulled together by the zig-zag folding possesses adequate stiffness so that the interwelded ends of the closure tape which form a holding band on only one side of the frill prevent the frill from falling apart.

The flattened filling side of the sack that is uniformly gathered to form a frill and that is secured against falling apart by the ends of the closure tape being welded together can be advantageously and simply slung about the clamping bars of lifting tackle by which the sack can be readily lifted and transported. Special ears or lugs which would make the sack more expensive can therefore be dispensed with.

One example of the invention will now be described in more detail with reference to the drawing, wherein:-

Figures 1, 2:
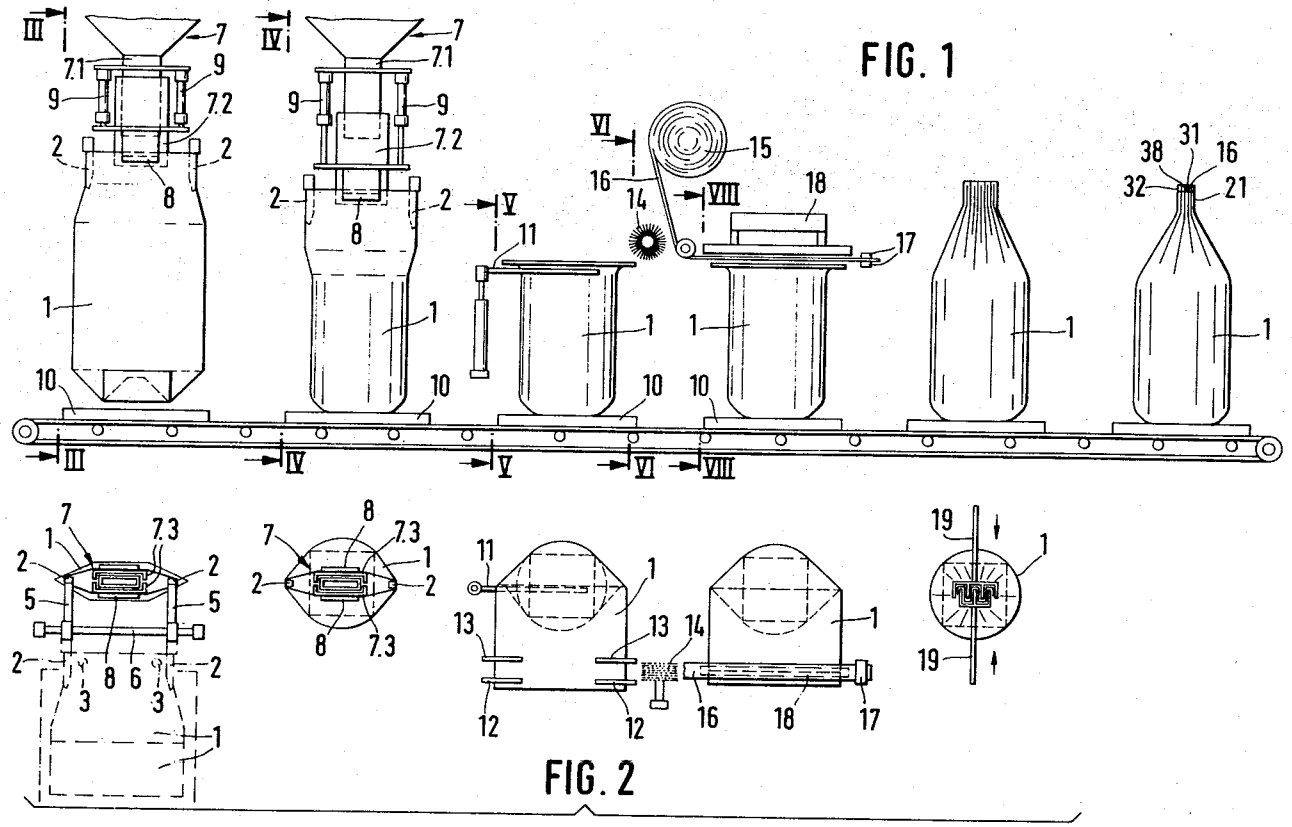
FIG. 1 is a diagrammatic side elevation showing the sack at the individual filling and closing stations.
FIG. 2 is a plan view of the sack at the individual stations of FIG. 1.
Figure 2A:
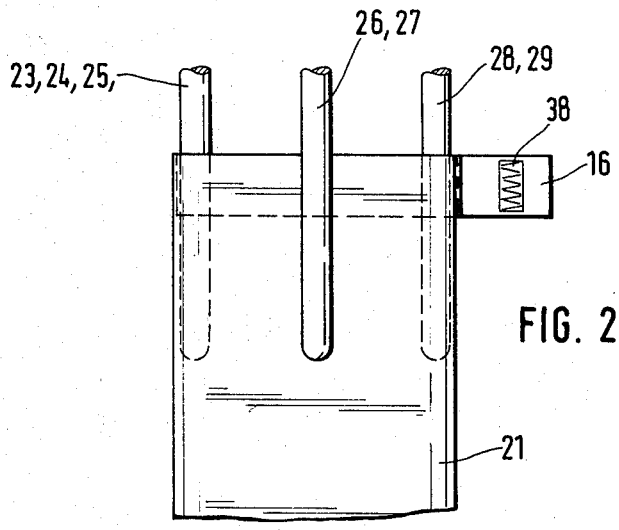
Figure 2B:
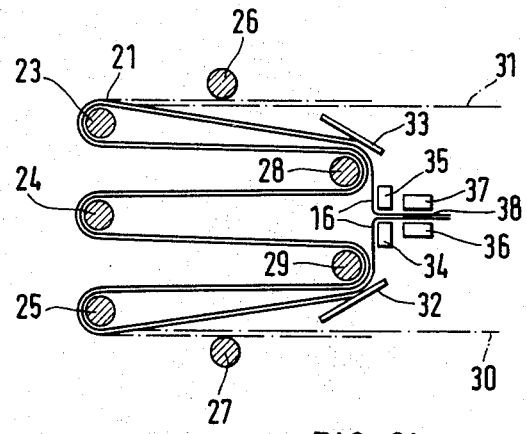
Figure 3:
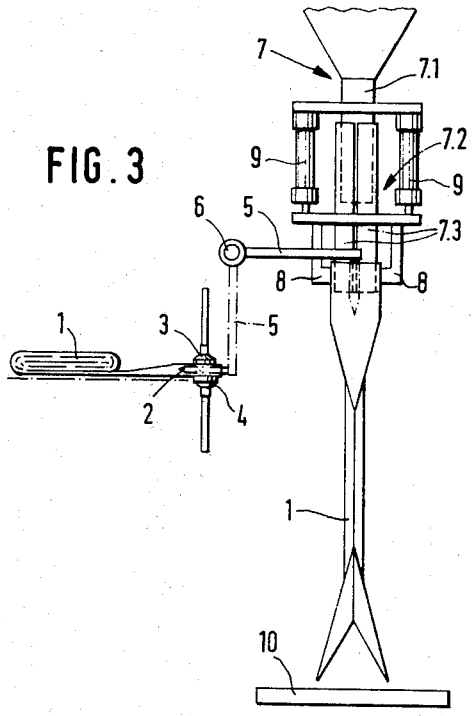
Figure 4:
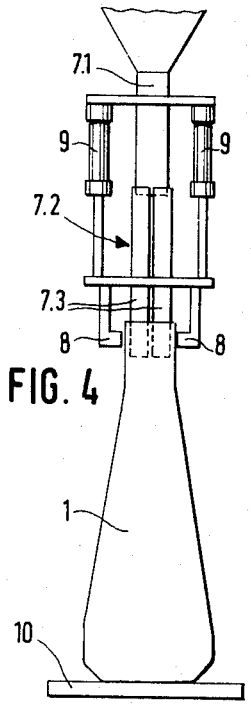
Figure 5:
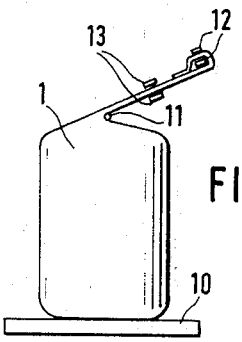
Figure 6:
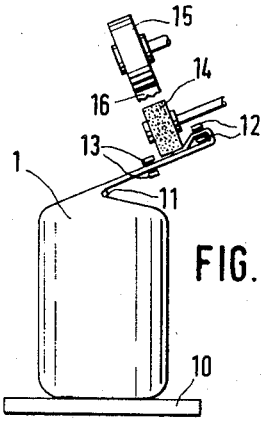
Figure 7:
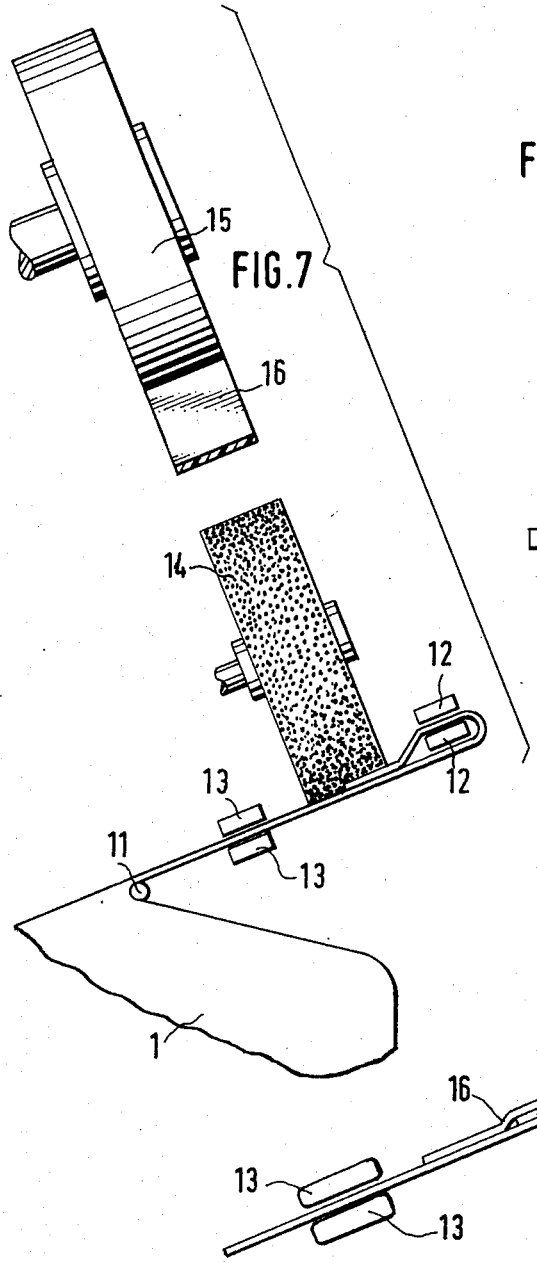
Figure 8:
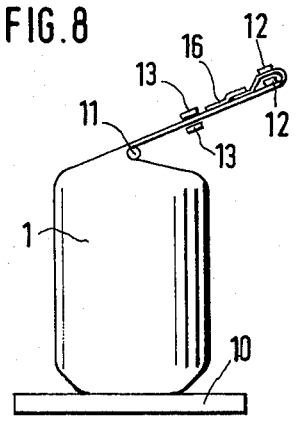
Figure 9:
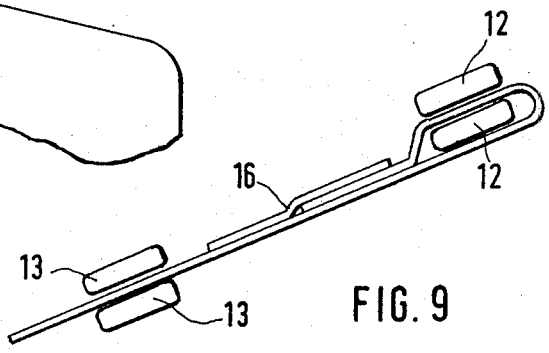

FIG. 2*a* is a side elevation of the filling side of the sack gathered by folding bars to form a frill and having projecting closure strips;

FIG. 2*b* is a plan view of the frill according to FIG. 2*a* with the closure tape open and the ends placed together for welding;

FIG. 3 is a section through the sack in its filling position, taken on the line III—III in FIG. 1;

FIG. 4 is a section through the sack in its filling position, taken on the line IV—IV in FIG. 1;

FIG. 5 is a section through the sack on the line V—V in FIG. 1;

FIG. 6 is a section through the sack on the line VI—VI in FIG. 1;

FIG. 7 is an enlarged representation of the closure tape roll and the cleaning brush;

FIG. 8 is a section through the sack on the line VIII—VIII in FIG. 1, and FIG. 9 is an enlarged representation of the sack end welded together with the closure tape.

At a first station comprising the gripping, suspension and filling of the sack as well as turning the filling end of the sack over, a sack 1 which lies flat or has been folded together is, as shown in FIG. 3, engaged at both sides of its upper end by grippers 2 after both of its side walls have been pulled apart by suckers 3, 4, which can also take place after gripping. The grippers 2 are secured to a swing arm 5 with a pivot shaft 6. The swing arm 5 swings in a substantially horizontal position so that the sack 1 is suspended freely and its filling end engages over the mouth of a filling funnel 7. The filling funnel 7 is made in two parts, the upper part 7.1 reaching into the lower part 7.2 and the lower part 7.2 consisting of two filling funnel segments 7.3 which can be spread apart. To the right and left adjacent the filling funnel mouth, there are clamping jaws 8 secured to the carrier of the spreadable filling funnel segments 7.3. On opening the filling funnel segments 7.3, each of the two walls of the upper end of the sack is clamped between a respective filling funnel segment 7.3 and one of the clamping jaws 8 and thereby held tight. The lower part 7.2 of the filling funnel 7 is movable with respect to the upper part 7.1 and surrounds the upper part 7.1. The clamping jaws 8 are fixed to the lower part 7.2. The two parts 7.1 and 7.2 are intercoupled by pressure cylinders 9 which are subjected to a given adjustable force by their pressure medium. The pourable material is first filled into the freely suspended sack, whereby the sack is stretched over its entire length, so that the sack can receive the predetermined quantity of contents. When, during filling, the increasing weight exceeds the set force of the pressure cylinders 9, the lower part 7.2 of the filling funnel 7 is lowered together with the sack 1 so that the base of the latter stands on a support 10 and the base is evenly filled out with filling material. By reason of the pretension by means of the pressure cylinders 9, the walls of the sack 1 are held taut so that no folds can be formed in the walls of the sack.

After filling, the grippers 2 are swung back to engage a new sack 1.

The walls of the filled sack 1 are folded sideways over a rod 11 disposed substantially above the filling height of the sack 1 and swung up to the middle of the sack, and engaged at a spacing from each other by pairs of grippers 12, 13. The gripper pair 12 folds the end of the sack back onto itself by turning through about 180°. For the purpose of cleaning, a rotary brush 14 is passed over the folded sack end and the adjacent portion of the sack wall on which the folded-over part lies, whilst the sack 1 is being conveyed to a second station. At the latter, a closure tape 16 is withdrawn from a supply roll 15 in that a gripper 17 movable to and fro in the feeding direction of the sack 1 engages the end of the closure tape 16. The withdrawal motion is preferably executed by the gripper 17 simultaneously with the feeding motion of the sack 1 from the first station to the second station whilst the sack 1 is being brought under the closure tape 16. The closure tape 16 is held by the gripper 17 partly over the sack wall and partly over the folded-over upper sack end and is there welded to the sack wall and the folded-over end by two weld seams with the aid of a stationary welding jaw 18.

The empty upper end of the sack 1 is erected vertically by moving the rod 11 upwardly and, by means of a folding tool 19 which consists of two parts and is moved from both sides in a horizontal direction towards the upper sack end, folded in zig-zag fashion with both parts interengaging in the manner of a comb. By means of pull rods with curved ends and disposed in a mirror image to one another, the zig-zag fold is gathered to form a frill 21. The curved ends for this purpose lie about the fold and move apart in opposite directions.

Instead of using folding tools 19 and pull rods, frill formation can also be effected by folding bars 23 to 29 as is evident from FIGS. *2a* and *2b*. After forming the frill, plates 32, 33 are pressed against the folding bars 28, 29 to locate the projecting ends 30, 31 of the closure tape 16. The free ends of the closure strip 16 are then passed between pressure bars 34, 35 and held together by same so that they can be welded together by the welding bars 36, 37. After welding, the welding bars 36, 37 are first lifted off the welding position 38. After cooling the seam, the pressure bars 34, 35 are also swung away so that the filling side gathered into a frill 21 is now held together only by the interwelded ends 30, 31 of the closure strip 16.

We claim:

1. A method of filling and closing large sacks, each large sack having a tube section including side walls, a base, and an open end portion to receive material to be poured therein, the method comprising the steps of:

engaging the open end portion of the sack at opposite sides thereof and opening the side walls of the sack;

freely suspending the sack from its open end portion;

depositing a pourable material through the open end portion of the freely suspended sack to partially fill the sack;

gradually lowering the sack onto a support when a predetermined weight of material is deposited therein while maintaining tension on the side walls of the sack;

laying together, stretching and inclining sideways through an angle, the sack walls disposed above the pourable material within the sack;

folding the upper end portion of the sack over onto itself;

placing closure tape onto the folded-over end portion of the sack and one sack wall;

welding the folded-over end portion to the sack wall;

moving the inclined side wall portion of the sack, disposed above the poured material, through an angle to a substantially vertical position;

placing closure tape around an upper portion of the sack;

folding the empty upper portion of the sack and tape in a zig-zag manner;

pulling the zig-zag folded portion together to form a frill; and welding ends of the closure tape projecting beyond sides of the flattened filling side to each other to thereby secure the frill against springing open.

2. The method of claim 1 further comprising the step of cleaning the upper end of the sack walls before the closure tape is applied.

3. The method of claim 1 wherein said engaging and opening steps comprise gripping the opposite sides of the open end portion of the sack by a pair of grippers and opening the sack by suckers; the depositing and lowering steps comprise providing a funnel having a filling nipple, and surrounding telescopic plates, clamping the upper end portion of the sack between the telescopic plates and a pair of clamping jaws, and gradually lowering the telescopic plates and clamping jaws when a predetermined weight of material is deposited from the filling nipple into the sack to lower the sack onto a conveyor for supporting the sack; and the laying together, stretching, inclining, and folding steps comprise gripping the upper end portion of the sack and pulling the empty upper portion of the sack over a bar, and then folding the upper end portion of the sack at the gripped portion; the folding step comprises providing a pair of folding plates at opposite sides of the upper portion of the sack, moving the folding plates towards each other to interengage in a comb-like manner to place the upper portion of the sack in a zig-zag line.

4. An apparatus for filling and closing large sacks, each large sack having a tube section including side walls, a base, and an open end portion to receive material to be poured therein, the apparatus comprising:

a funnel;

gripping means for engaging a sack and for feeding the sack to the funnel for depositing material into the sack, the funnel having a filling nipple;

a pair of telescopic plates surrounding the filling nipple of the funnel;

clamping means for clamping the sack to the pair of telescopic plates comprising a pair of clamping jaws adjacent the pair of telescopic plates;

lowering means for gradually lowering the clamping jaws and a pair of telescopic plates, when the sack is partially filled with a predetermined amount of material, to a conveying means;

conveying means for conveying the partially filled sack to a closure means for closing the upper portion of the sack; and closure means comprising second gripping means for gripping the end portions of the sack together, means for stretching the side walls of the sack comprising a bar and means for moving the bar relative to the sack, folding means for folding over the end portion of the sack, means for welding a closure tape over the folded-over end portion of the sack to the sack wall, a pair of folding plates having interengagable comb-like projections, means for placing closure tape around an end portion of the sack, means for compressing the end portion of the sack and closure tape between the folding plates to form a zig-zag fold in the end portion of the sack, and means for welding ends of the closure tape projecting beyond sides of the flattened end portion to each other to thereby secure the end from springing open.

5. Apparatus according to claim 4 wherein the telescopic plates are interconnected with the filling nipple by a piston-cylinder pressure medium unit.

* * * * *